United States Patent [19]

Sugihara

[11] Patent Number: 4,603,723

[45] Date of Patent: Aug. 5, 1986

[54] SHUTTER

[75] Inventor: Toshihiko Sugihara, Mihara, Japan

[73] Assignee: Kyoritsu Kikai Co., Ltd., Hiroshima, Japan

[21] Appl. No.: 654,784

[22] Filed: Sep. 26, 1984

[30] Foreign Application Priority Data

Oct. 18, 1983 [JP] Japan ..... 58-194976

[51] Int. Cl.[4] ..... E06B 9/32

[52] U.S. Cl. ..... 160/35; 160/116; 160/180; 160/206

[58] Field of Search ..... 160/116, 180, 185, 202, 160/35, 206, 32, 33, 36, 201

[56] References Cited

U.S. PATENT DOCUMENTS

| | | | |
|---|---|---|---|
| 812,722 | 2/1906 | Cahill | 160/116 |
| 888,862 | 5/1908 | Wilson | 160/116 |
| 1,989,658 | 1/1935 | McCloud | 160/116 |
| 4,460,030 | 7/1984 | Tsunemura | 160/35 |

FOREIGN PATENT DOCUMENTS

| | | | |
|---|---|---|---|
| 528030 | 4/1954 | Belgium | 160/116 |
| 657377 | 2/1963 | Canada | 160/201 |
| 412254 | 4/1910 | France | 160/201 |
| 1210068 | 10/1970 | United Kingdom | 160/35 |

*Primary Examiner*—Reinaldo P. Machado
*Assistant Examiner*—Alvin Chin-Shue
*Attorney, Agent, or Firm*—Austin R. Miller

[57] ABSTRACT

A shutter which has a number of wide slats connected to each other by a hinge mechanism with the slats remaining separate so that an opening for a side gate can be formed at a desired position on the shutter.

The slats of the side gate are connected vertically to each other or horizontally with other slats and the connection can be released at any time desired.

The side gate provided at a part of the shutter allows access even when the shutter is closed, yet the side gate can be folded as a part of the shutter.

15 Claims, 12 Drawing Figures

SHUTTER

BACKGROUND OF THE INVENTION

This invention relates to a shutter having a side gate. With shutters of conventional type, there is no open passage for people when the shutters are closed completely. For access of people, therefore, it is necessary to open the shutters completely.

Narrow shutters are provided in some cases as it is quite troublesome to open a wide shutter completely. Even with a narrow shutter, however, it is troublesome and inconvenient to lift and lower the shutter. To eliminate the trouble, it is desirable to provide the shutter with a side gate.

As another type, the use of a motor powered automatic up-down mechanism is also possible. The mechanism, however, is not favored as the open-shut operation is disabled upon power failure. Installation of a hydraulic pressure lock is compulsory so that a fire squad can open the shutter from the outside and because the mechanism is expensive. A side gate can eliminate the need of such hydraulic pressure locks and is convenient. The slats composing the shutters of conventional type, however, are generally narrow to ensure easy rolling for housing. It has been regarded as impossible, therefore, to provide such a shutter with a side gate.

BRIEF SUMMARY OF THE INVENTION

In view of the foregoing, it is a general object of this invention to provide a shutter having a side gate for easy access even after being closed, yet can be rolled up for housing.

DETAILED DESCRIPTION OF THE INVENTION

Figure 1:
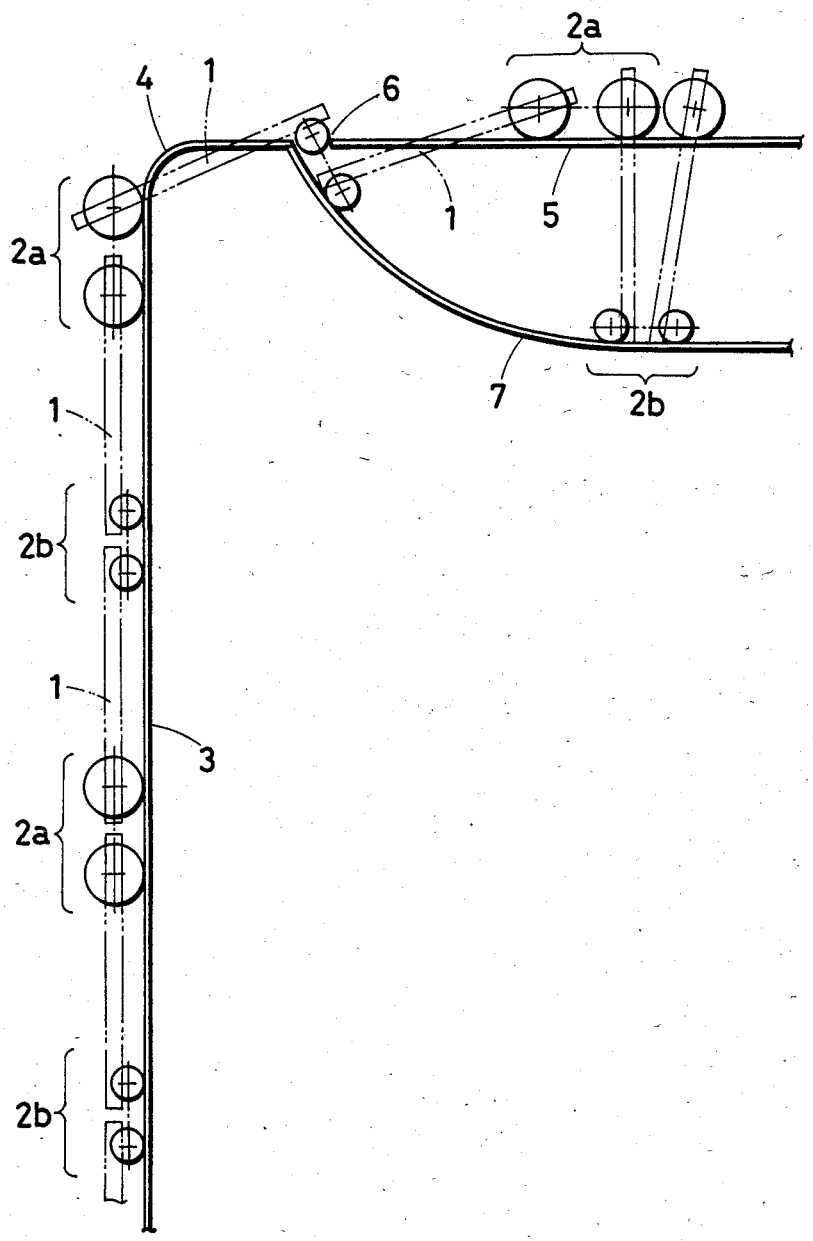
FIG. 1 is a side view of the housing mechanism of the shutter.

FIG. 1 shows an example of the housing mechanism of the shutter by this invention. The slats 1 . . . are wider than those of conventional type shutters and are provided at both ends with groups of large diameter rollers 2*a* . . . and of small diameter rollers 2*b* . . . which are connected to each other between adjacent slats and are arranged alternately, larger and smaller. At the vertical section 3 and the arc section 4 of the guide post, both groups of rollers 2*a* and 2*b* run the same route. The notch 6 provided at the inlet of the horizontal guide 5 allows only the small diameter rollers 2*b* to come inside.

Figure 2:
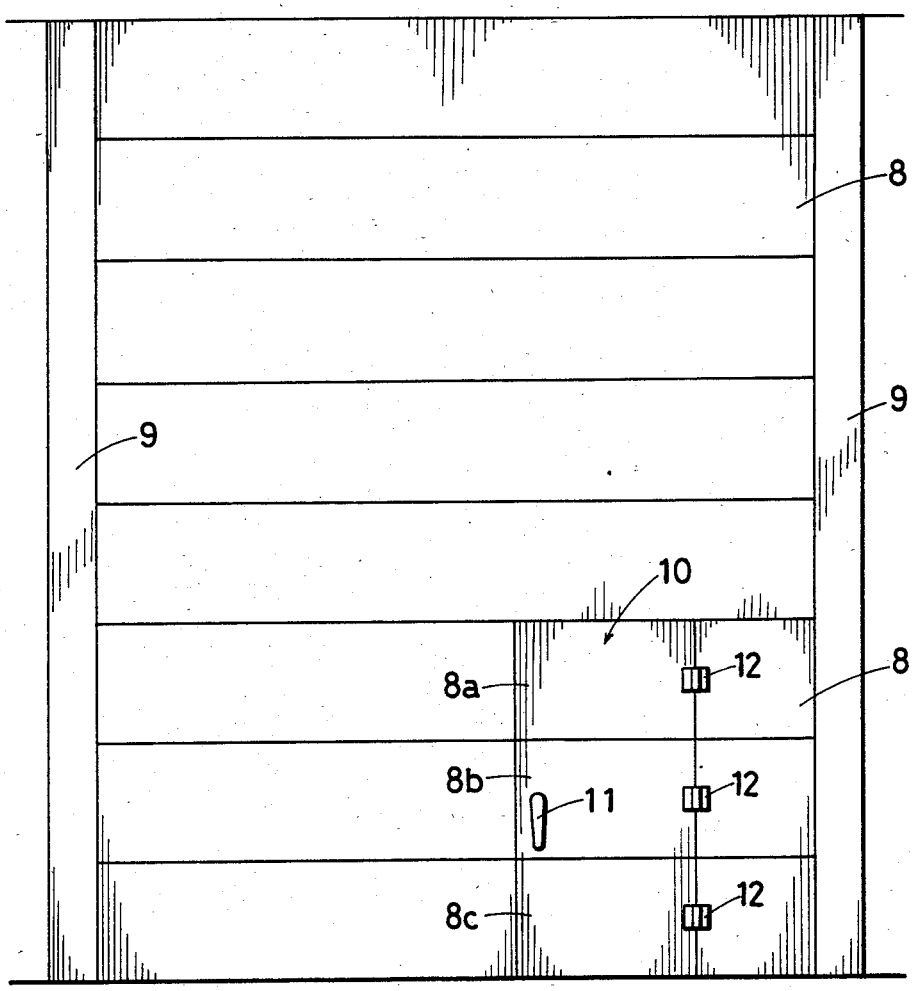
FIG. 2 is a front view to show an embodiment of the shutter by this invention.

The large diameter rollers 2*a* go past the notch 6 without dropping past guide 5 and the small diameter rollers 2*b* go down the notch 6 toward the guide 7. Thus, the slats 1 . . . are folded and housed one after another. As shown in FIG. 2, a part of the shutter having wide slats 8 . . . is cut to form an opening for a side gate and the hinged door 10 as the side gate is formed by the slats which are cut and separated. In the drawing, 9 are the guide posts, 11 is the door handle and 12 are hinges.

Figure 3:
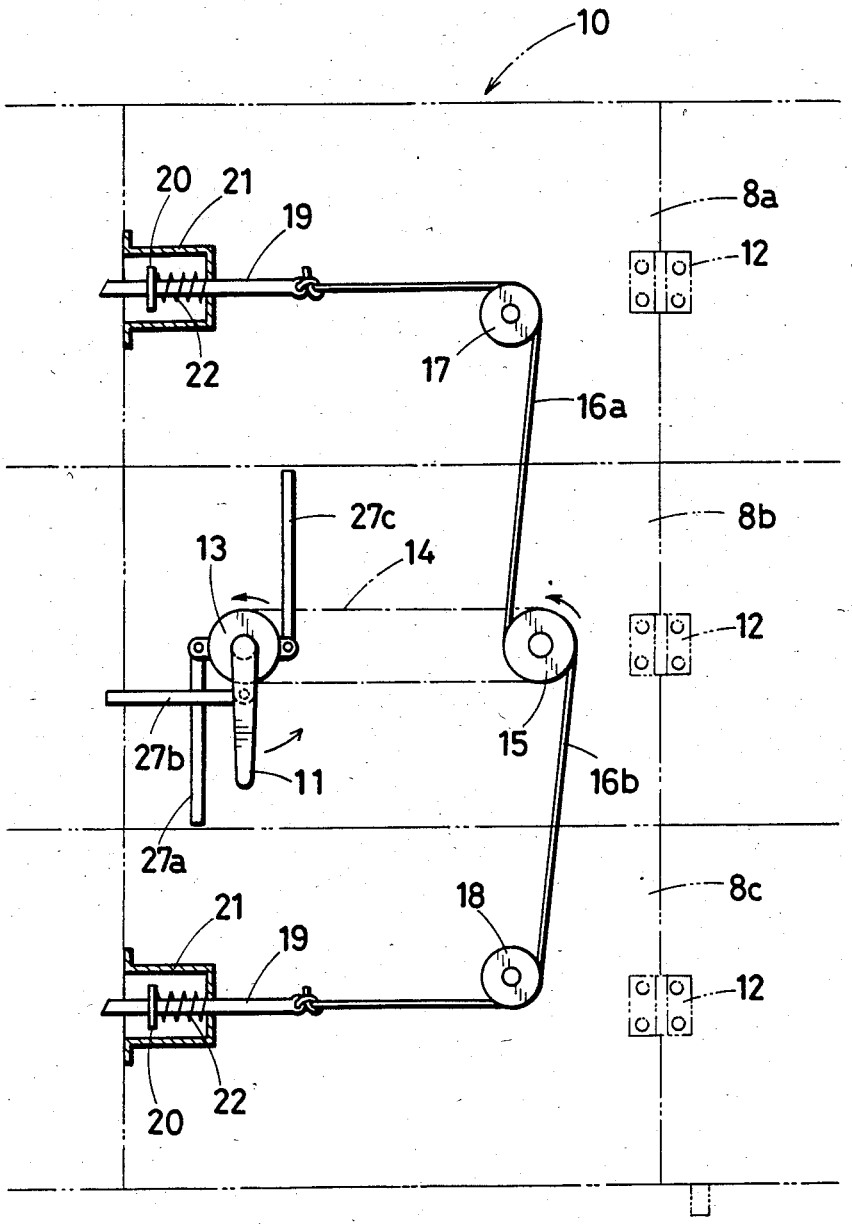
FIG. 3 is a front view to show the internal structure of the shutter of FIG. 2.
Figure 4:
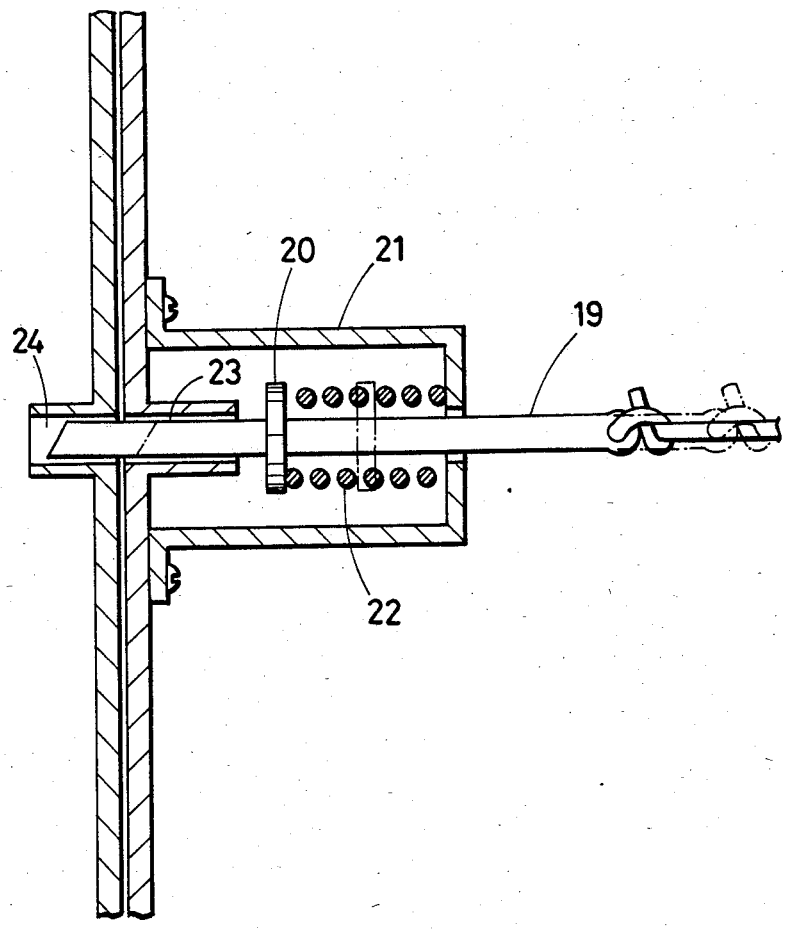
FIG. 4 and FIG. 5 are partly enlarged front views to show the inside of the shutter of FIG. 2.

The internal structure of the hinged door is shown in FIG. 3. The handle 11 on the surface of the slat 8*b* of the hinged door 10 is fixed onto a side of a sprocket wheel 13 so that the sprocket wheel 13 turns in the same direction as handle 11. Revolution of the sprocket wheel 13 is transferred to another sprocket wheel 15 inside the center slat 8*b* of the hinged door through a chain 14. The 2nd sprocket wheel 15 has rope races (not illustrated) around the periphery and in parallel to the sprocket (not illustrated). Two wires 16*a* and 16*b* are wound around the rope races and the wires 16*a* and 16*b* are connected to the connecting rods 19 in the upper slat 8*a* and the lower slat 8*c*, which are connected to the shutter proper, after being guided by the sheave 17 in the upper slat 8*a* and the sheave 18 in the lower slat 8*c*. As illustrated in FIG. 4, each connecting rod 19 is supported by a bracket 21 and has a collar 20 around the rod in the bracket 21. A spring 22 is wound around the rod from the collar 20 toward a shaft hole of the bracket 21 and pushes against collar 20 and accordingly against rod 19 toward the top end of each connecting rod 19 at all times.

Figure 5:
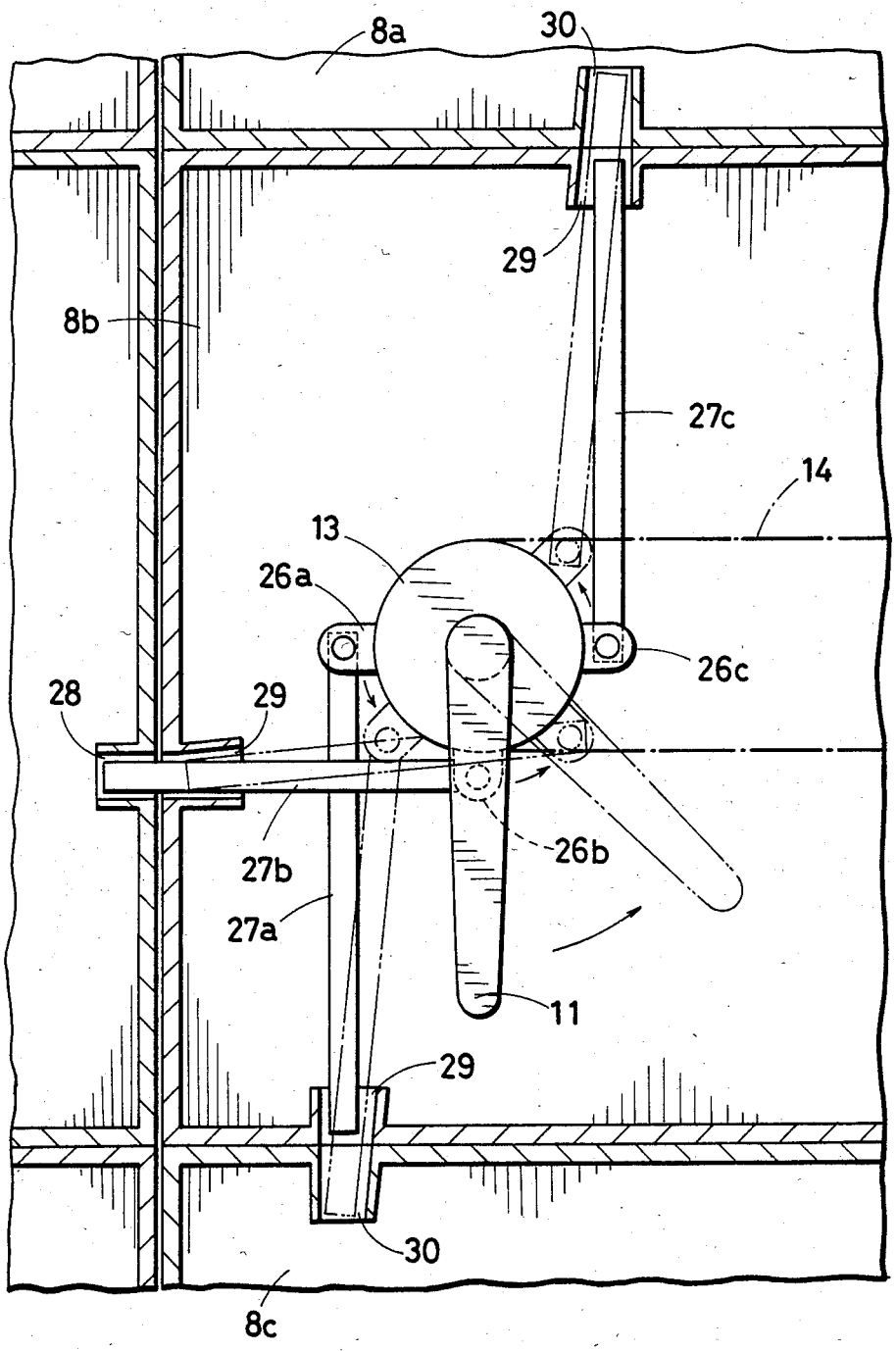
Figure 6:
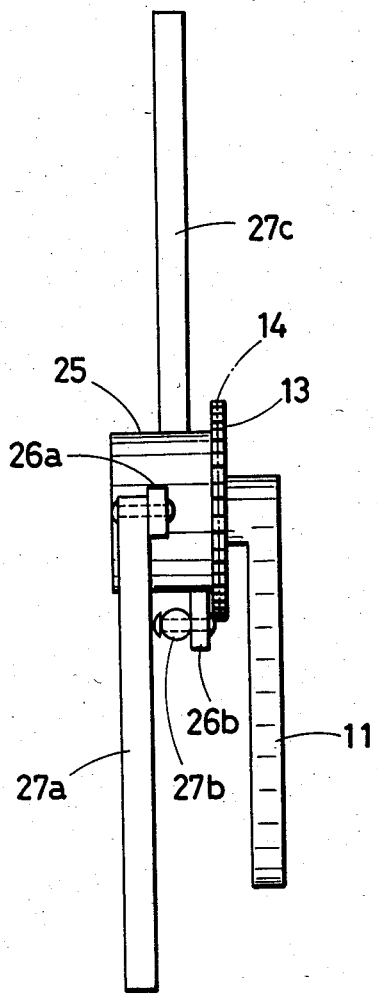
FIG. 6 is a partial side view of the shutter of FIG. 5.

As illustrated in FIG. 3 and FIG. 4, connecting rods 19 go back and forth between the guide hole 23 at the side of the slats 8*a* and 8*c* and the insert hole 24 at the side of the shutter proper. When the rods are inserted into the insert holes 24, the slats 8*a* and 8*c* are connected horizontally to the shutter proper. The 1st sprocket wheel 13 having the handle 11 has a shaft 25 of fairly large diameter though smaller than that of the sprocket wheel 13 extended to the opposite side of the handle 11, as shown in FIG. 6. As illustrated in FIG. 5, the shaft 25 is provided with bearings 26*a*, 26*b* and 26*c* at both sides and the bottom when the top of the handle 11 is in a downward position.

Figure 7:
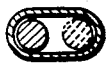
FIG. 7 is a sectional view to show the guide hole and the insert hole composing the shutter of FIG. 2.

From the bearing 26*a* at the left side, a rod 27*a* extends to the bottom of the slat 8*b* being attached so as to turn freely. From the bearing 26*c* at the right side, a rod 27*c* extends to the top of the slat 8*b* being attached so as to turn freely. From the bearing 26*b* at the bottom of the shaft 25 a rod 27*b* extends toward the left side being attached so as to turn freely and the top end reaches the insert hole 28 provided on the shutter proper. At the edges of the slat 8*b* where the top of the rods 27*a*, 27*b* and 27*c* reach, a guide hole 29 is provided each, and beyond the ends of the rods 27*a* and 27*c* an insert hole 30 is also provided at the end of the adjacent slats 8*a* and 8*c*. As shown in FIG. 7, each one of the guide holes and insert holes are formed in the shape of an oval so as to deflect each rod sideways. As shown in FIG. 6, the rod 27*a* facing downward and the rod 27*b* facing leftward are kept off fore and back so as not to come into contact with each other. The location of the rods, however, may be reversed. Now follows a description of the open-shut operation of the hinged door. As illustrated in FIG. 5, the rod 27*b* extending leftward from the 1st sprocket wheel 13 is moved by the movement of the bearing 26*b* from the insert hole 28 on the shutter proper to the guide hole 29 at the left end of the slat 8*b*, as shown by the alternate long and two short dash lines when the handle 11 is turned in a counter-clockwise direction as shown by the arrows. The other two rods 27*a* and 27*c* respectively, go into the insert hole 30 of the adjacent slats 8*c* and 8*a* as the bearings 26*a* and 26*c* respectively come close to the slats 8*c*, 8*a* as shown by the alternate long and two short dash lines.

As shown in FIG. 3, on the other hand, revolution of the 1st sprocket wheel 13 is transmitted to the 2nd sprocket wheel 15 through the chain 14. When the 2nd sprocket wheel 15 turns, the two wires 16*a* and 16*b* are wound up and the connecting rods 19 respectively connected to the wires 16*a* and 16*b* are moved backward from the insert hole 24 on the shutter side to the guide hole 23 on the slats 8*a* and 8*c*, as shown in FIG. 4 (by the alternate long and short dash line). When the handle 11 is turned, the connecting rods 19 and the rod 27*b* which connect the shutter proper to the slats 8*a*, 8*b* and 8*c* are moved into the slats 8*a*, 8*b* and 8*c* to release the connection as described above. At the same time, the rods 27*c* and 27*a* connect the slats 8*a* to 8*b* and 8*b* to 8*c*, thereby effecting a vertical connection. The hinged door can be opened under this condition. The springs 22 wound around the connecting rods 19 are pushed between the collar 20 and the inside of the bracket 21 and store the force to push back the collar 20 toward the top of the rod. If the hinged door 10 is closed and the handle 11 is released under the turned condition of the handle 11, the coiled power of the springs 22 functions. By the power of the springs 22, the connecting rods 19 automatically lock the slats 8*a* and 8*c* to the shutter proper thereby effecting a horizontal connection. At the same time, the wires 16*a* and 16*b* are pulled back, the 1st sprocket wheel 13 is returned to the original position, and the rod 27*b* extending to the left side reaches the shutter proper for locking (Horizontal connection). The other rods 27*a* and 27*c* are released from the adjacent slats 8*c* and 8*a*. In the above embodiment, the handle 11 is used for the open-shut operation of the hinged door and the vertical and horizontal connections are made simultaneously with this open-shut operation. It is preferable that the conditions of the vertical and horizontal connections are locked to a degree that is easily released when the handle is turned. To house a shutter of this structure, the hinged door may be kept closed for housing. Since the slats of the hinged door are locked to the shutter proper and the locks between the slats are released, the hinged door causes no problem for housing.

If the shutter is folded for housing as shown in FIG. 1 for example, the springs wound around the connecting rods absorb tension of the wires generated at folding of the slats and function to prevent unlocking of the connecting rods. The housing method of the shutter, however, is not ncessarily confined to the method as described above.

Figure 8:
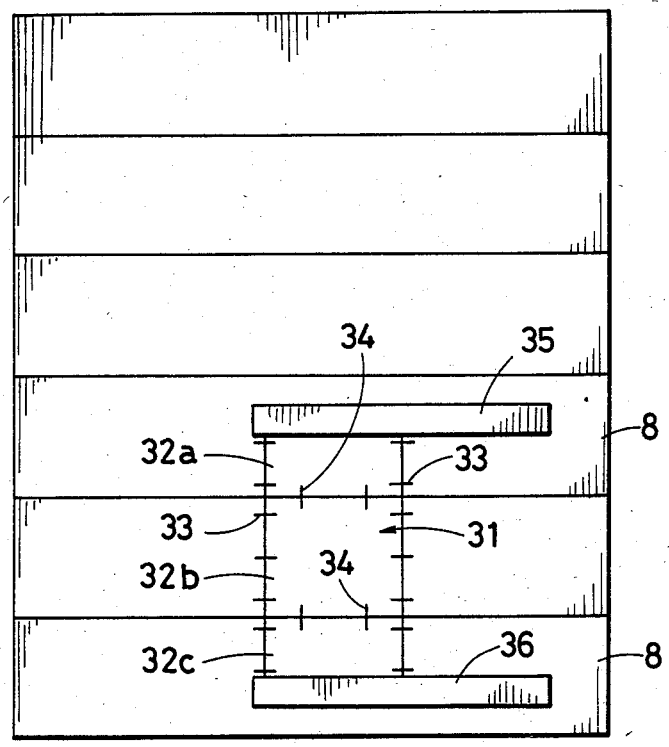
FIG. 8 and FIG. 9 are respectively a front view and a side view of another embodiment of the shutter by this invention.
Figure 9:
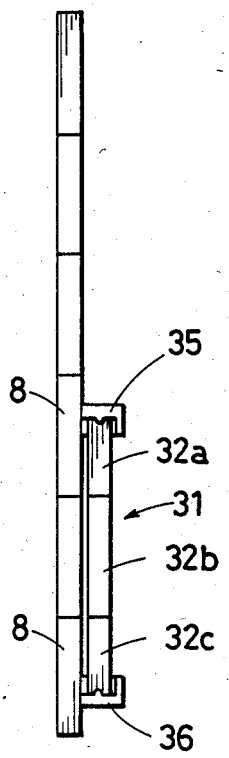

Now follows a description of an embodiment of the sliding door of the shutter by this invention. As shown in FIG. 8, the sliding door 31 is housed in the shutter proper before use and is connected to the shutter proper by flush bolts 33 at several points on both sides. Slats 32*a*, 32*b* and 32*c* which compose the sliding door 31 utilize flush bolts 34 . . . between the slats to connect each slat. Before use, however, the slats are not connected yet. As shown in FIG. 9, the shutter proper is provided with the upper and lower rails 35 and 36 for the sliding door 31 on the surface of two of the slats.

When the sliding door is used, the slats 32*a*, 32*b* and 32*c* are connected to each other and are fixed by the flush bolts 34 . . . between each slat of the sliding door 31. Then flush bolts 33 . . . at both sides of the sliding door are pulled out, the sliding door 31 is drawn out of the shutter proper and is fitted into the upper and lower rails 35 and 36. Thus, the sliding door 31 can be moved horizontally on the lower rail 36.

To house the shutter, the sliding door 31 is taken off the rails 35 and 36 to fit into the shutter proper, then the sides of the sliding door 31 are connected to the shutter proper with flush bolts 33 . . . . Then all the flush bolts 34 . . . connecting the slats 32*a*, 32*b* and 32*c* composing the sliding door 31 are unlocked. The shutter can be housed under this condition by any method such as rolling, folding, or sliding. If the rails are obstructive when the shutter is housed, the shutter may be constructed so as to house the rails into the slats.

Figure 10:
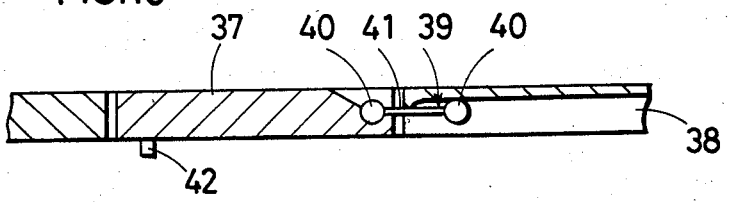
FIG. 10 is a partial section to show still another embodiment of the shutter by this invention.
Figure 11:
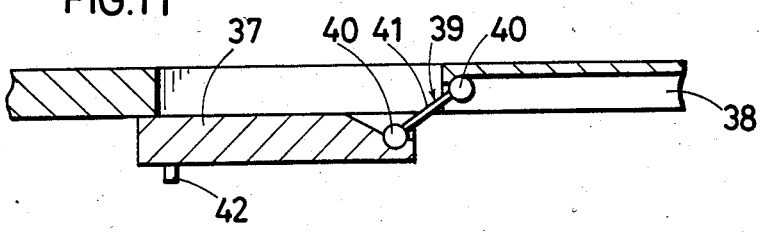
FIG. 11 and FIG. 12 are respectively a sectional view and an oblique view to explain the operation of the shutter of FIG. 10.
Figure 12:
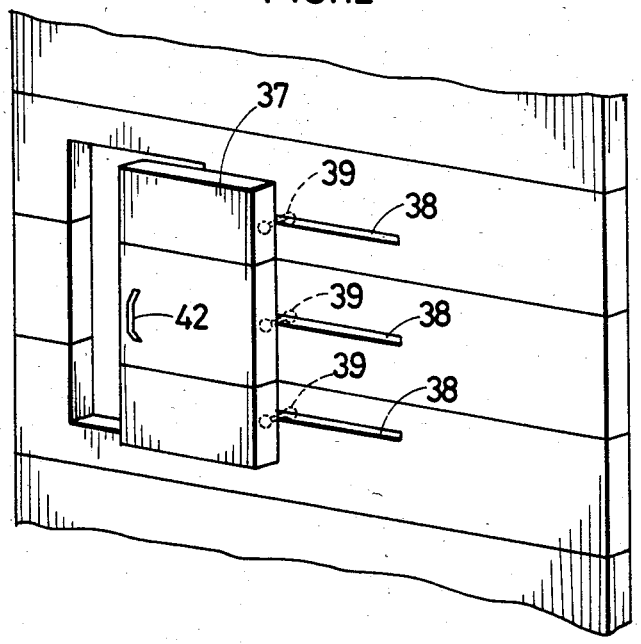

FIG. 10 to FIG. 12 show another embodiment of the sliding door. In these drawings, the connectors 39 are attached to the sliding door 37 so that the shaft 41 can turn to any angle between the two balls 40. The connectors 39 connect the sliding door 37 to the shutter proper and move along the groove rails 38 provided on the slat surface of the shutter proper when the sliding door 37 is pulled.

The opening of each groove rail 38 is a little narrrower than the inside and is formed a little wider than the shaft 41 of the connector 39. When pulled by the sliding door 37, each connector 39 moves through while leaving one of the balls 40 in the groove rail 38 and is never pulled out of the groove rail 38. When the sliding door is used, the slats of the sliding door are connected to each other, then the connection between both sides of the sliding door and the shutter proper is released, as shown in the above embodiment. Then the housed sliding door 37 (shown in FIG. 10) is drawn out of the shutter proper as shown in FIG. 11 and is placed onto the rail (not illustrated). When the shutter is housed, the same procedure as the above embodiment may be taken. Door handle 42 is shown in FIGS. 10, 11 and 12.

For the shutter of this invention, the hinged door is designed to open to the side. The structure, however, may be a trap door type or a bottom-hinged type door. In one embodiment, the connection between the hinged door and the shutter proper is made simultaneously with the open-shut operation of the hinged door. The connection, however, is not limited thereto and it is also possible to separate the connection with the shutter proper from the open-shut operation by using a coupling device such as bolts or latches. Although only one coupling device is provided to one side of the slats in the above embodiment, it may be two or more. For locking the shutter, on the other hand, a separate lock such as mono-lock may be used instead of the type which also serves for coupling. For the sliding door, there is no limitation on the coupling means used. It is also acceptable to provide the shutter with a balancing device or to adjust the weight of each slat because upper-lower or right-left balance upon opening and closing the shutter may change when a hinged door is provided.

Being constructed as described above, the shutter of the present invention allows access even when it is closed, yet can be housed smoothly.

What is claimed is:

1. A shutter comprising a number of slats connected to each other by a hinge mechanism in which the slats are connected yet separable, an opening for a side gate formed at a desired position, and having slats and a handle comprising vertical and horizontal connecting rods, wherein the slats of the side gate are releasably connected vertically to each other by the vertical rods and are horizontally connected to the shutter slats by the horizontal rods, whereby the horizontal connection is releasably connected and some of said horizontal rods which connect the side gate to the shutter in order to shut the side gate and the handle which operates the rods are connected by wires and upon releasing the horizontal connection, said side gate slats are simultaneously vertically connected.

2. A shutter as set forth in claim 1, wherein the slats of the side gate are connected at one side with the slats of the shutter proper adjacent to the side by a hinge mechanism forming a hinged door.

3. A shutter as defined by claim 1, in which the slats of the side gate are made into a sliding door which slides to the right and left in a rail formed on one side of the shutter.

4. A shutter capable of repeatedly sliding on guide posts from a closed position to an open position such that said shutter includes a multiplicity of rollers some of which are larger than others, said shutter being stored on support means when in the open position, said shutter comprising:

a plurality of slats having ends and longitudinal edges;

a plurality of roller hinge mechanisms arranged for rolling on said guide posts and said support means; said hinge mechanism comprising connecting means which includes pairs of larger rollers and pairs of smaller rollers arranged alternately to connect said slats to one another such that said longitudinal edges of said slats are adjacent when said shutter is in the closed position and are separable yet connected when in open positions.

5. A shutter as defined in claim 4, wherein said shutter contains a side gate cut out of said slats of said shutter.

6. A shutter as defined in claim 4, wherein said support means comprises a substantially horizontal support guide placed so as to receive said shutter from said guide post.

7. A shutter as defined in claim 6, wherein said support means further comprises said support guide having a slot capable of allowing said smaller rollers to drop through.

8. A shutter as defined in claim 7, wherein said support means further comprises a lower support guide positioned below said support guide to receive said smaller rollers as they drop through said slot.

9. A side gate for a shutter, said shutter being made of a plurality of slats wherein said slats are connected at either end yet remain separable, said side gate comprising:

portions of said plurality of shutter slats;

a locking mechanism comprising vertical locking means capable of vertically locking said slat portions together, and horizontal locking means capable of horizontally locking said slat portions together with said shutter slats, whereby unlocking said slat portions with said shutter simultaneously locks the slat portions together; and horizontal hinge means capable of hinging said slat portions to said shutter slats.

10. A side gate as defined in claim 9, wherein said hinge means comprises:

a shaft; and a ball attached at either end of said shaft such that a first ball is slidably positioned within a groove in said slat of said shutter and a second ball is rotatably positioned within a groove in said slat of said side gate such that said side gate is capable of pivoting away from said shutter and sliding along said grooves into an open position.

11. A side gate as defined in claim 9, wherein said hinge means comprises:

an upper rail attached to said shutter and positioned above said side gate to provide guidance to said side gate when sliding; and a lower rail attached to said shutter and positioned below said side gate to receive said side gate therein and to provide guidance to and support for said side gate when sliding.

12. A side gate as defined in claim 11, wherein said vertical locking means and horizontal locking means comprises a plurality of removable flush bolts.

13. A side gate as defined in claim 9, wherein said vertical locking means and said horizontal locking means operate in concert such that said vertical locking means are released when said gate is unlocked, and said horizontal locking means are released when said side gate is unlocked and locked when said side gate is locked.

14. A side gate as defined in claim 13, wherein said vertical locking means and said horizontal locking means comprise:

a rotatable sprocket wheel having a vertical connecting rod for each adjacent side gate slat and a horizontal connecting rod;

a connecting rod for each side gate slat;

a bracket for receiving connecting rods mounted on each side gate slat; and means connected between said sprocket wheel and said connecting rods to repeatedly lock and unlock said side gate when said sprocket wheel is rotated.

15. A side gate as defined in claim 14, wherein said means connected between said sprocket wheel and said connecting rods to repeatedly lock and unlock said side gate when said sprocket wheel is rotated comprises a plurality of rotatable wheels and a plurality of wires which are connected to said rotatable wheels and are connected between said connecting rods and said sprocket wheel.

* * * * *